US008622767B2

(12) United States Patent
Nakazura et al.

(10) Patent No.: US 8,622,767 B2
(45) Date of Patent: Jan. 7, 2014

(54) CONNECTOR

(75) Inventors: Kazumi Nakazura, Kanagawa (JP); Tomoyuki Satoh, Kanagawa (JP)

(73) Assignee: Kyocera Connector Products Corporation, Kanagawa (JP)

( * ) Notice: Subject to any disclaimer, the term of this patent is extended or adjusted under 35 U.S.C. 154(b) by 1 day.

(21) Appl. No.: 13/540,921

(22) Filed: Jul. 3, 2012

(65) Prior Publication Data

US 2013/0012071 A1 Jan. 10, 2013

(30) Foreign Application Priority Data

Jul. 5, 2011 (JP) ..... 2011-149008

(51) Int. Cl.
*H01R 13/62* (2006.01)

(52) U.S. Cl.
USPC ..... 439/499

(58) Field of Classification Search
USPC ..... 439/260, 325, 327, 328, 495, 499, 630
See application file for complete search history.

(56) References Cited

U.S. PATENT DOCUMENTS 4,712,848 A * 12/1987 Edgley ..... 439/327
6,089,905 A * 7/2000 Shimmyo et al. ..... 439/495
7,044,773 B2 * 5/2006 Suzuki et al. ..... 439/495
7,494,366 B2 * 2/2009 Suzuki et al. ..... 439/495
8,292,648 B2 * 10/2012 Kiryu et al. ..... 439/328

FOREIGN PATENT DOCUMENTS

| | | |
|---|---|---|
| JP | 09161895 | 6/1997 |
| JP | 2008053246 | 3/2008 |
| JP | 2009070758 | 4/2009 |
| JP | 2009266457 | 11/2009 |

* cited by examiner

*Primary Examiner* — Khiem Nguyen
(74) *Attorney, Agent, or Firm* — McCornick, Paulding & Huber, LLP

(57) ABSTRACT

A connector includes an insulator, into which a thin plate-like object is removably insertable, including contact insertion grooves and partition walls positioned therebetween and contacts inserted into the contact insertion grooves, each of the contacts including first and second contact portions spaced from each other to allow the thin plate-like object to be inserted therebetween, and including a connecting portion connecting the first and second contact portions. At least one of the first and second contact portions contacts the thin plate-like object when inserted into the insulator. A hollow portion having a greater width than the contact insertion grooves is formed in each partition wall to superimpose part of each contact as viewed in a contact arranging direction, and the partition walls prevent each hollow portion from being communicatively connected with the contact insertion grooves.

8 Claims, 8 Drawing Sheets

CONNECTOR

CROSS REFERENCE TO RELATED APPLICATION

The present invention is related to and claims priority of the following co-pending application, namely, Japanese Patent Application No. 2011-149008 filed on Jul. 5, 2011.

BACKGROUND OF THE INVENTION

1. Field of the Invention

The present invention relates to a connector to which a thin plate-like connecting object such as an FPC or FFC, etc., is to be connected.

2. Description of Related Art

A connector via which a circuit board (rigid board) and a thin plate-like (thin sheet or thin plate) connecting object (e.g., an FPC or FFC, etc.) are electrically connected is usually provided with an insulator and a plurality of contacts. The insulator is provided with a groove into which the connecting object is insertable, and from which the connecting object is removable, and a plurality of contact insertion grooves which are elongated in the connecting object insertion/removal direction and arranged in a direction orthogonal to the connecting object insertion/removal direction, and the plurality of contacts are inserted into the plurality of contact insertion grooves of the insulator, respectively. The plurality of contacts are connected to conductor traces of a circuit pattern formed on a surface of the circuit board. Upon the connecting object being inserted into the aforementioned groove of the insulator, the connecting object comes into contact with each of the aforementioned plurality of contacts, so that the circuit board and the connecting object are electrically connected to each other via the plurality of contacts.

Such a conventional connector is disclosed in Japanese Patent Publication No. 4,413,961.

To improve the high frequency property of an electrical signal fed to this type of connector (the contacts thereof), it is required to make the impedance (value) of the connector as close to the impedance (value) of the circuit board and the connecting object as possible.

However, the insulator is provided with partition walls which are formed between the plurality of contact insertion grooves so that each partition wall separates the adjacent contact insertion grooves from each other, and the relative permittivity of the synthetic resin which forms the insulator is usually high (e.g., approximately three to four). Accordingly, such a conventional type of connector has a structure in which the coupling capacitance between adjacent contacts easily increases, and the impedance (value) of the connector tends to decrease largely as compared with the impedance (value) of the circuit board and the connecting object.

SUMMARY OF THE INVENTION

The present invention provides a connector in which a plurality of contacts are arranged on an insulator and supported thereby, and which is configured to be capable of improving the high frequency property of the connector.

According to an aspect of the present invention, a connector is provided, including an insulator, into which a thin plate-like object to be connected to the connector is removably insertable, including a plurality of contact insertion grooves and a plurality of partition walls that are positioned between the contact insertion grooves to separate the contact insertion grooves from one another, the contact insertion grooves being elongated in an insertion/removal direction of the thin plate-like object and arranged in a direction orthogonal to the insertion/removal direction; and a plurality of contacts which are inserted into the contact insertion grooves, respectively, each of the contacts including a first contact portion and a second contact portion that are spaced from each other in a direction of thickness of the thin plate-like object to allow the thin plate-like object to be inserted in between the first contact portion and the second contact portion, and further including a connecting portion which connects the first contact portion and the second contact portion to each other, wherein at least one of the first contact portion and the second contact portion comes in contact with the thin plate-like object when the thin plate-like object is inserted into the insulator. A hollow portion having a greater width than each of the contact insertion grooves is formed in each of the partition walls of the insulator in a manner such that the hollow portion superimposes part of each contact of the contacts as viewed in a contact arranging direction in which the contacts are arranged, and in a manner such that each of the plurality of partition walls prevents each corresponding the hollow portion from being communicatively connected with the contact insertion grooves in the contact arranging direction.

It is desirable for the hollow portion to be greater in dimension in the direction of thickness of the thin plate-like object than each of the contact insertion grooves.

It is desirable for the hollow portion to be formed in the insulator so as to superimpose part of the connecting portions of the plurality of contacts as viewed in the contact arranging direction.

It is desirable for the first contact portion to be fixed to a bottom wall of the insulator, and for the hollow portion to be formed in the insulator so as to superimpose both the first contact portion and a portion of the second contact portion extending from the connecting portion and along the second contact portion the insertion/removal direction as viewed from a lateral side of the insulator.

It is desirable for a recess to be formed on a surface of the first contact portion which faces the bottom wall of the insulator.

It is desirable for the hollow portion to be formed in the insulator so as to superimpose the recess as viewed in the contact arranging direction.

It is desirable for the thin plate-like object to include an FPC including at least one circuit trace which extends along an elongated direction of the thin plate-like object; and an insulating cover layer which covers both sides of the FPC except both ends of the circuit trace. The circuit trace includes a land which is positioned outside the insulating cover layer and comes into contact with at least one of the first contact portion and the second contact portion, an end of the land adjacent to an edge of the insulating cover layer being formed to decrease in width gradually in a direction toward the edge of the insulating cover layer; and a connecting portion which is smaller in width than the land, except the end of the land, and extends linearly from the end of the land to the edge of the insulating cover layer.

It is desirable for the FPC to include at least one ground trace which extends along the elongated direction of the thin plate-like object.

In the present invention, a hollow portion having a greater width than each contact insertion groove is formed in each partition wall of the insulator in such a manner as to superimpose part of each contact as viewed in a contact arranging direction in which the plurality of contacts are arranged, and in such a manner as to be prevented from being communicatively-connected with the plurality of contact insertion grooves in the contact arranging direction by the plurality of partition walls. The relative permittivity of this hollow portion (air space) is 1, thus being lower than the relative permittivity of a typical insulator (partition wall). Accordingly, in the connector according to the present invention, the coupling capacitance between adjacent contacts does not easily increase, so that the impedance (value) of the connector can be brought closer to the impedance (value) of the circuit board and the connecting object as compared with a conventional connector having no hollow portion (corresponding to the hollow portion provided in the present invention). Therefore, the high frequency property of an electrical signal fed to the connector (the contacts thereof) can be improved.

BRIEF DESCRIPTION OF THE DRAWINGS

The present invention will be discussed below in detail with reference to the accompanying drawings, in which.

DESCRIPTION OF THE EMBODIMENTS

Figure 1:
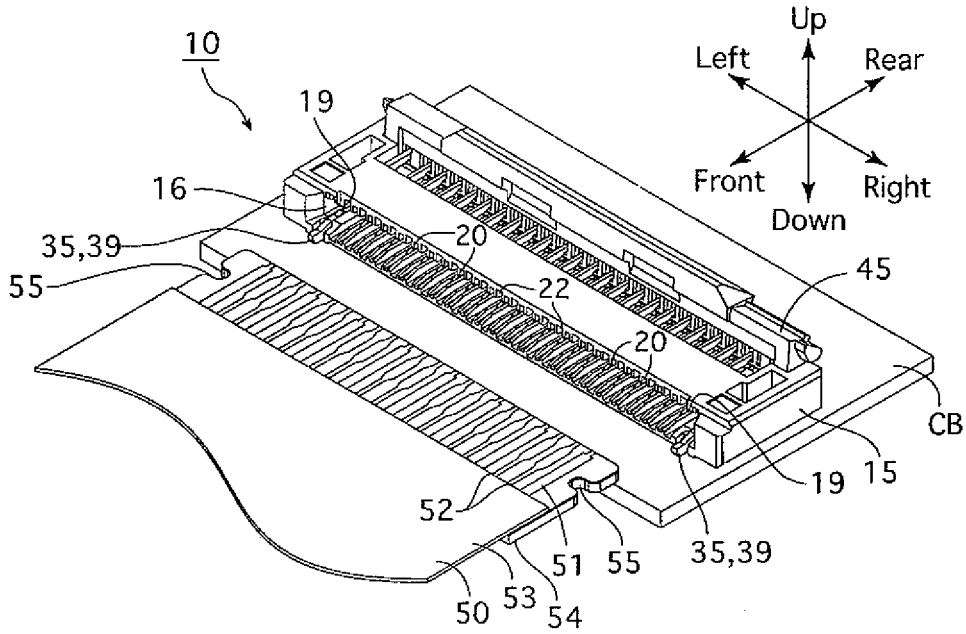
FIG. 1 is a front perspective view of an embodiment of a connector according to the present invention, showing a state where the rotational actuator of the connector is in the unlocked position.
Figure 2:
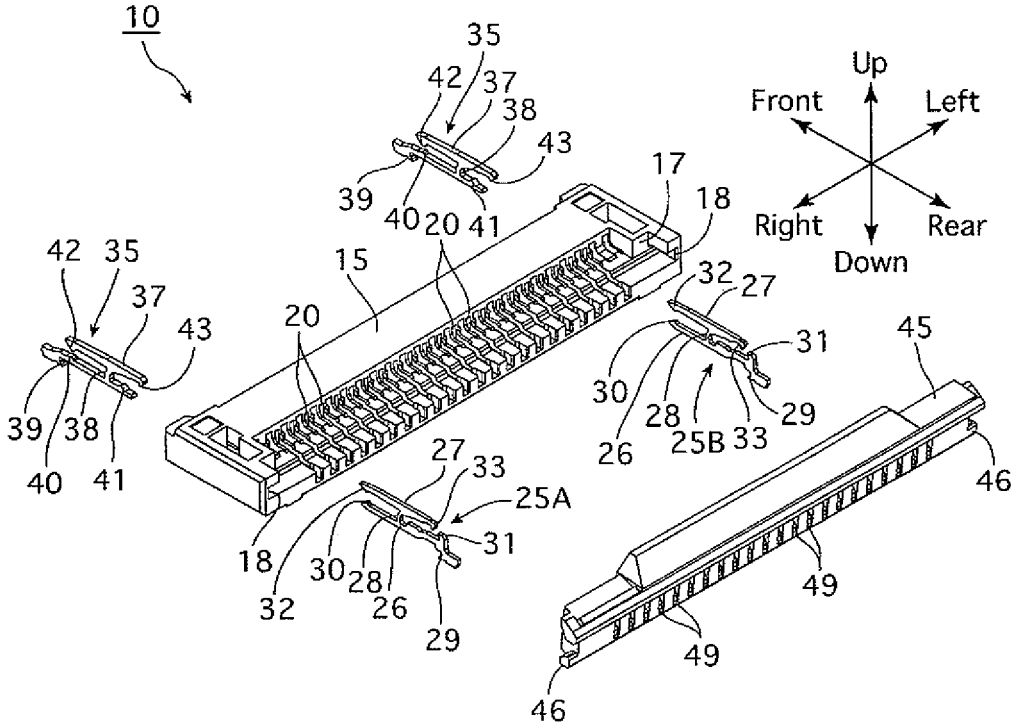
FIG. 2 is an exploded rear perspective view of the connector.
Figure 3:
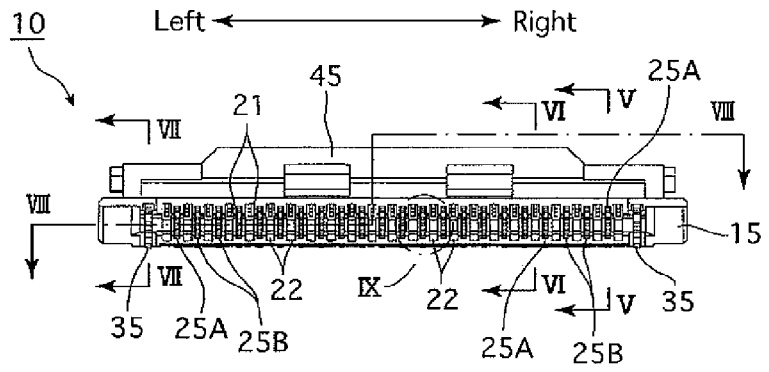
FIG. 3 is a front elevational view of the connector with the rotational actuator in the unlocked position.
Figure 4:
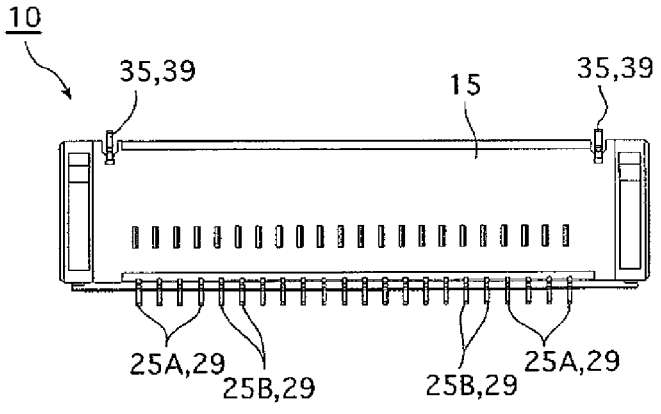
FIG. 4 is a bottom view of the connector with the rotational actuator in the unlocked position.

An embodiment of a connector according to the present invention will be hereinafter discussed with reference to FIGS. 1 through 15. In the following descriptions, forward and rearward directions, leftward and rightward directions, and upward and downward directions of the connector 10 are determined with reference to the directions of the double-headed arrows shown in the drawings.

The connector 10 is a so-called back flip lock connector and can accommodate differential transmission for seven circuits. The connector 10 is provided with an insulator 15, a total of twenty-two contacts consisting of eight ground contacts 25A and fourteen signal contacts 25B, two fastening clips 35 and a rotational actuator 45, which constitute major components of the connector 10.

Figure 7:
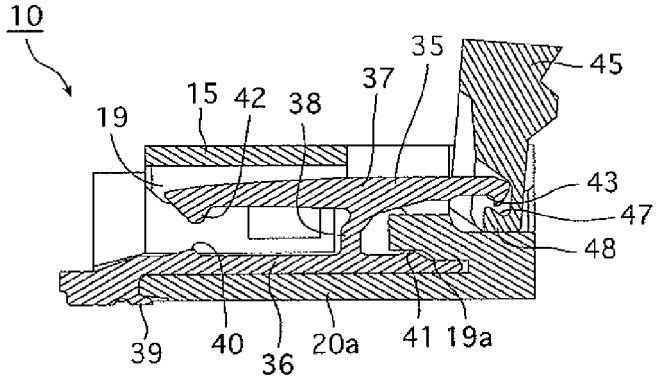
FIG. 7 is a cross sectional view taken along the line VII-VII shown in FIG. 3, viewed in the direction of the appended arrows.
Figure 8:
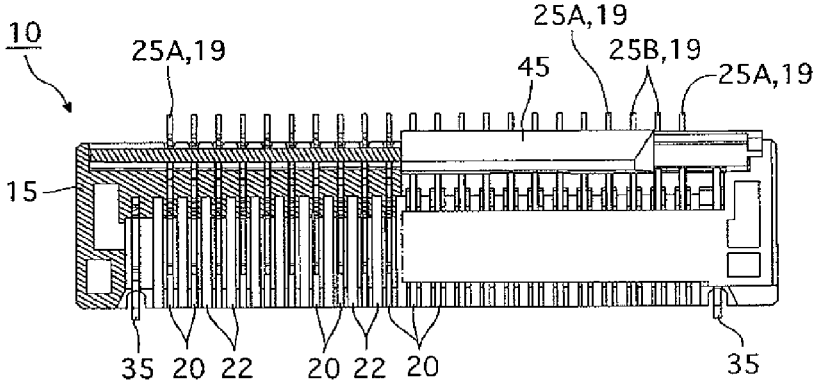
FIG. 8 is a cross sectional view taken along the line VIII-VIII shown in FIG. 3, viewed in the direction of the appended arrows.
Figure 9:
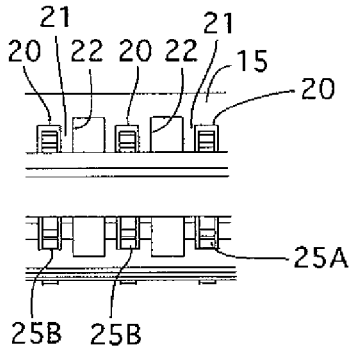
FIG. 9 is an enlarged view of a portion of the connector indicated by the one-dot chain line IX shown in FIG. 3.

The insulator 15 is formed from electrical-insulative and heat-resistant synthetic resin by injection molding. The insulator 15 is provided, on the front thereof except the left and right ends, with an FPC insertion groove 16 which is recessed rearward to a middle part of the insulator 15. The insulator 15 is provided, on the rear side thereof except the left and right ends, with an actuator receiving recess 17. The insulator 15 is provided, on the rear surfaces thereof in the vicinity of the left and right sides of the insulator 15, with a pair of bearing recesses 18, respectively, which are communicatively connected to the rotational actuator receiving recess 17. The insulator 15 is provided, at the front thereof in the vicinity of the left and right ends of the insulator 15, with a left and right pair of fastening-clip installation grooves 19, respectively, which are linearly formed to elongate in the rearward direction. As shown in FIG. 7, each fastening-clip installation groove 19 is substantially (lowercase) h-shaped in a side view (resembling a reversed lowercase h lying on its side). In addition, the insulator 15 is provided, at the front thereof between the left and right pair of fastening-clip installation grooves 19, with a total of twenty-two contact insertion grooves 20 which are linearly formed to elongate in the rearward direction and are arranged at predetermined intervals (at intervals of 0.5 mm) in the leftward/rightward direction. As shown in the drawings, each contact insertion groove 20 is open at both ends in the forward/rearward direction and is substantially (lowercase) h-shaped in a side view (resembling a reversed lowercase h lying on its side). The insulator 15 is provided between the twenty-two contact insertion grooves 20 with a total of twenty-one partition walls 21 which respectively separate corresponding adjacent pairs of the twenty-two contact insertion grooves 20 from one another. Each partition wall 21 is substantially (lowercase) h-shaped in a side view (resembling a reversed lowercase h lying on its side). The insulator 15 is provided in different portions thereof (specifically, portions of the twenty-one partition walls 21, a portion of the insulator 15 between the leftmost contact insertion groove 20 and the left fastening-clip installation groove 19 and a portion of the insulator 15 between the rightmost contact insertion groove 20 and the right fastening-clip installation groove 19), with a total of twenty-three hollow portions 22, respectively, which are arranged in the leftward/rightward direction. Each hollow portion 22 is substantially (lowercase) h-shaped in a side view (resembling a reversed lowercase h lying on its side) (see FIG. 6). As shown in the drawings, both sides (left and right sides) of each hollow portion 22 that is respectively formed in the partition walls 21 are closed by the partition walls 21, respectively. In addition, as shown in FIG. 9, each hollow portion 22 is greater in width than each contact insertion groove 20 (specifically, the width of each hollow portion 22 is 0.2 mm and the width of each contact insertion groove 20 is 0.13 mm in this particular embodiment) and also greater in dimension in the vertical direction than each contact insertion groove 20. Additionally, the left side of the leftmost hollow portion 22 is closed by part of the insulator 15 and the right side of the rightmost hollow portion 22 is closed by another part of the insulator 15.

The total of twenty-two contacts (the eight ground contacts 25A and the fourteen signal contacts 25B) are each formed from a thin base material made of a resilient copper alloy (e.g., phosphor bronze, beryllium copper or titanium copper) or a resilient Corson-copper alloy and formed into the shape shown in the drawings (by stamping), and is firstly coated with nickel (Ni) plating as base plating and subsequently with gold (Au) plating as finish plating. The thickness (dimension in the leftward/rightward direction) of each contact 25A and 25B is 0.1 mm.

As shown in the drawings, the eight ground contacts 25A and the fourteen signal contacts 25B are each substantially H-shaped in a side view and is provided with a fixed contact portion (first contact portion) 26, a movable contact portion (second contact portion) 27 and a deformable connecting portion (connecting portion) 28. The fixed contact portion 26 is elongated substantially in the forward/rearward direction. The movable contact portion 27 is elongated substantially in the forward/rearward direction and is shorter than the fixed contact portion 26. The deformable connecting portion 28 is resiliently deformable and connects middle portions of the fixed contact portion 26 and the movable contact portion 27 to each other. The fixed contact portion 26 is provided, on the bottom surface thereof in the vicinity of the rear end of the fixed contact portion 26, with a recess 25*a*. The recess 25*a* has a trapezoidal shape in a side view and is recessed over the entire width of the fixed contact portion 26 in the leftward/rearward direction. The fixed contact portion 26 is provided at the rear bottom end thereof with a hook-shaped engaging portion (tail portion) 29 which projects downward and forward. The fixed contact portion 26 is provided on the top and at the front end thereof with a contacting projection (lower contacting projection) 30. The fixed contact portion 26 is also provided on the top thereof at the rear end of the fixed contact portion 26 with a hook 31 which curves so as to project upward and forward. The movable contact portion 27 is provided at the front end thereof with a contacting projection (upper contacting projection) 32 which projects downward, and is further provided, on a lower surface of the movable contact portion 27 in the vicinity of the rear end thereof, with a locking recess (pressure-receiving portion) 33 which is recessed upward.

Figure 5:
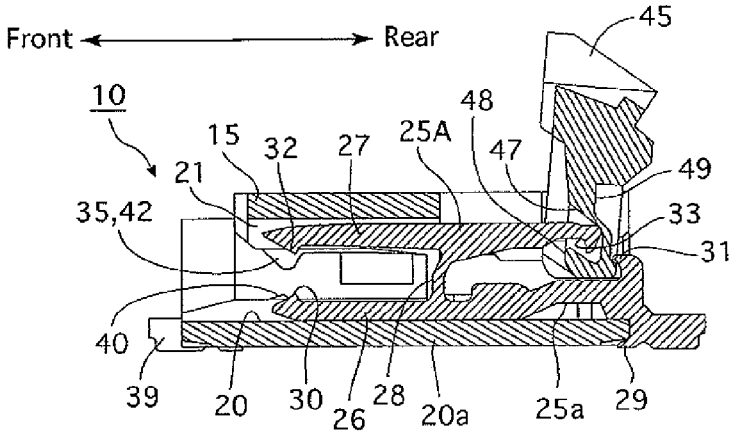
FIG. 5 is a cross sectional view taken along the line V-V shown in FIG. 3, viewed in the direction of the appended arrows.
Figure 6:
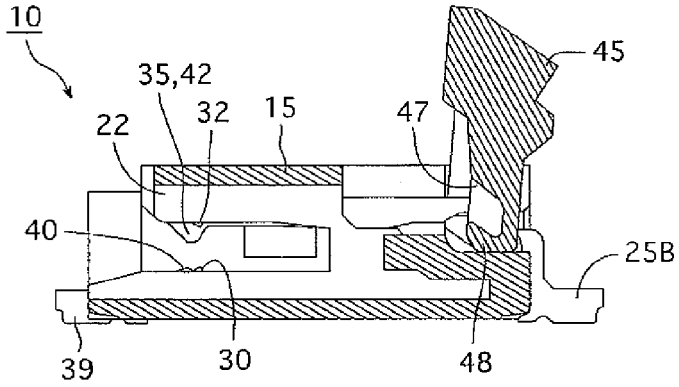
FIG. 6 is a cross sectional view taken along the line VI-VI shown in FIG. 3, viewed in the direction of the appended arrows.
Figure 11:
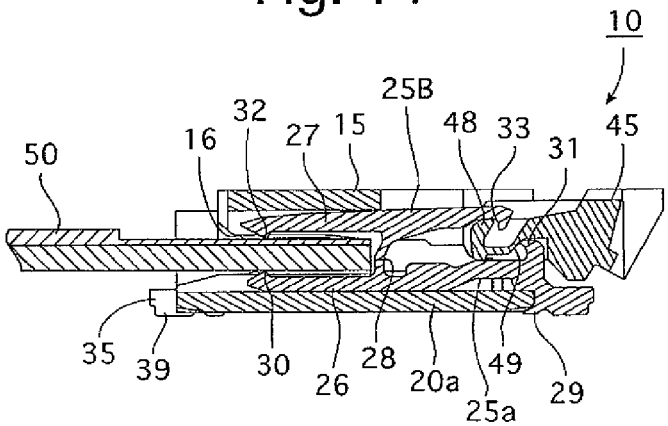
FIG. 11 is a cross sectional view similar to that of FIG. 5, showing the connector and the FPC in the same state as that shown in FIG. 10.

The eight ground contacts 25A and the fourteen signal contacts 25B are inserted into the twenty-two contact insertion grooves 20, respectively, from the rear of the insulator 15. More specifically, the ground contacts 25A are inserted into two left and right end contact insertion grooves 20 and six contact insertion grooves 20 provided therebetween at regular intervals (one ground contact 25A per every three contact insertion grooves), and two signal contacts 25B are respectively inserted into two contact insertion grooves 20 that are positioned between two adjacent ground contacts 25A. As shown in FIGS. 5 and 11, upon each contact 25A and 25B being inserted into the associated contact insertion groove 20, a lower surface of the fixed contact portion 26 of each contact 25A and 25B comes in contact with the bottom surface of the associated contact insertion groove 20, the upper surface of the movable contact portion 27 of each contact 25A and 25B is spaced downward from the top surface of the associated contact insertion groove 20, and the hook-shaped engaging portion 29 of the fixed contact portion 26 of each contact 25A and 25B is engaged with the rear edge of a bottom wall 20*a* of the insulator 15. In addition, an engaging projection (not shown) formed on a side of the fixed contact portion 26 of each contact 25A and 25B digs into (cuts into) a side surface in the associated contact insertion groove 20 (not shown), and accordingly, the fixed contact portion 26 of each contact 25A and 25B is fixed to the bottom of the associated contact insertion groove 20 (the bottom wall 20*a* of the insulator 15). In addition, the entire lower surface of the fixed contact portion 26 of each contact 25A and 25B except the portion thereof on which the recess 25*a* is formed is in contact with the bottom of the associated contact insertion groove 20 (the bottom wall 20*a* of the insulator 15), and accordingly, both a portion of the lower surface of the fixed contact portion 26 immediately in front of the recess 25*a* and another portion of the lower surface of the fixed contact portion 26 immediately behind the recess 25*a* (this portion is positioned immediately above the front end of the associated hook-shaped engaging portion 29) are in contact with the bottom of the associated contact insertion groove 20.

The left and right fastening clips 35 are press-formed products that are formed out of sheet metal. Each fastening clip 35 is provided with a fixed portion 36, a movable portion 37 and a deformable connecting portion 38. The fixed portion 36 is elongated substantially in the forward/rearward direction. The movable portion 37 is elongated substantially in the forward/rearward direction and is shorter than the fixed portion 36. The deformable connecting portion 38 is resiliently deformable and connects middle portions of the fixed portion 36 and the movable portion 37 to each other. The fixed portion 36 is provided, on the bottom surface in the vicinity of the front end thereof, with a hook-shaped engaging portion 39 which projects downward and rearward. The fixed portion 36 is provided, on front and rear portions of the top surface thereof, with an engaging projections 40 and a lock-engaging projection 41, respectively. The movable portion 37 is provided at the front end thereof with an engaging projection 42 which projects downward, and is further provided, on a lower surface of the movable portion 37 in the vicinity of the rear end thereof, with a locking recess 43 which is recessed upward.

The left and right fastening clips 35 are inserted into the left and right pair of fastening-clip installation grooves 19, respectively, from the front of the insulator 15. As shown in FIG. 7, upon each fastening clip 35 being inserted into the associated fastening-clip installation groove 19, a lower surface of the fixed portion 36 of each fastening clip 35 comes in contact with the bottom surface of the associated fastening-clip installation groove 19, the upper surface of the movable portion 37 of each fastening clip 35 is spaced downward from the top surface of the associated fastening-clip installation groove 19, and the hook-shaped engaging portion 39 of the fixed portion 36 of each fastening clip 35 is engaged with the front edge of the bottom wall 20*a* of the insulator 15. In addition, the lock-engaging projection 41, which is projected from the rear of the fixed portion 36 that is inserted into a rear end 19*a* of the associated fastening-clip installation groove 19, digs into (cuts into) an upper surface in the rear end 19*a* of the associated fastening-clip installation groove 19, and accordingly, the fixed portion 36 of each fastening clip 35 is fixed to the bottom of the associated fastening-clip installation groove 19 (the bottom wall 20*a* of the insulator 15).

The rotational actuator 45 is a tabular shaped member elongated in the leftward/rightward direction and molded out of a heat-resistant synthetic resin by injection molding using a metal mold. The rotational actuator 45 is provided, at lower ends of the left and right side surfaces thereof, with a pair of (left and right) pivots 46, respectively, which project in opposite directions away from each other in the leftward/rightward direction to be coaxial with each other. The rotational actuator 45 is provided, on a surface thereof (front surface with respect to FIGS. 1 and 5 or upper surface with respect to FIGS. 10 and 11) in the vicinity of the lower end of this surface, with a total of forty five recesses 47 which are arranged in the leftward/rightward direction. The rotational actuator 45 is provided, at the lower end (pivoted end) thereof except both ends of this lower end in the leftward/rightward direction, with a cam portion (pressing portion) 48 which extends in the leftward/rightward direction. In addition, the rotational actuator 45 is provided in the rear surface thereof (rear surface with respect to FIGS. 1 and 5 or lower surface with respect to FIGS. 10 and 11) with a total of twenty-two retaining recesses 49 arranged in the leftward/rightward direction.

The rotational actuator 45 is mounted on the insulator 15 to be rotatable about the left and right pivots 46 with the lower end (except the left and right pivots 46) of the rotational actuator 45 being positioned in the rotational actuator receiving recess 17 and with the left and right pivots 46 being rotatably engaged into the left and right bearing recesses 18 of the insulator 15, respectively. The rotational actuator 45 is rotatable between an unlocked position (shown in FIGS. 1, 3 and 5 through 7), in which the rotational actuator 45 extends substantially orthogonal (vertical) to the insulator 15, and a locked position (shown in FIGS. 10 and 11), in which the rotational actuator 45 lies substantially horizontal.

When the rotational actuator 45 is in the unlocked position as shown in FIGS. 1 and 5, the rear end of the movable contact portion 27 of each contact 25A and 25B is loosely engaged in the associated recess 47 of the rotational actuator 45, so that the cam portion 48 does not press the locking recess 33 of the movable contact portion 27. In addition, an inner-edge surface of each retaining recess 49 of the rotational actuator 45 contacts the lower surface of the front-end projecting portion of the hook 31. Additionally, the rear end of the movable contact portion 37 of each fastening clip 35 is loosely engaged in the associated recess 47 of the rotational actuator 45, so that the cam portion 48 does not press the locking recess 43 of the movable portion 37.

Figure 10:
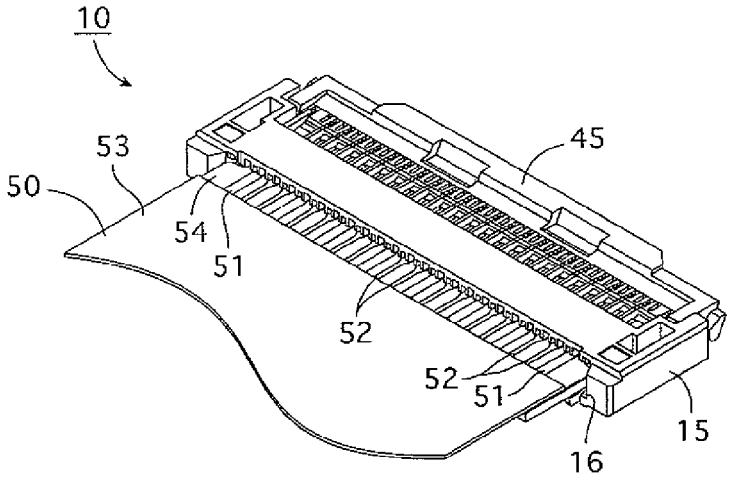
FIG. 10 is a front perspective view of the connector and an insertion end of an FPC inserted into the connector with the rotational actuator in the locked position.

On the other hand, rotating the rotational actuator 45 to the locked position as shown in FIGS. 10 and 11 causes the cam portion 48 of the rotational actuator 45 to press the locking recess 33 of the movable contact portion 27 of each contact 25A and 25B upward, thus causing the front end of the movable contact portion 27 of each contact 25A and 25B to rotate downward about the associated deformable connecting portion 28 while resiliently deforming this deformable connecting portion 28. In addition, this rotation of the rotational actuator 45 to the locked position causes the hook 31 of each contact 25A and 25B to be engaged in the base portion of the associated retaining recess 49. In addition, since the cam portion 48 of the rotational actuator 45 presses the locking recess 43 of the movable portion 37 of each fastening clip 35 upward (though this action is not shown in the drawings), this pressing operation causes the front end of the movable portion 37 of each fastening clip 35 to rotate downward about the associated deformable connecting portion 38 while resiliently deforming this deformable connecting portion 38.

The connector 10 that has the above described structure is mounted onto a top surface of a circuit board CB (see FIG. 1) by soldering the hook-shaped engaging portion 29 of each contact 25A and 25B to an associated conductor trace of a circuit pattern (not shown) formed on the top surface of the circuit board CB and by soldering the hook-shaped engaging portion 39 of each fastening clip 35 to an associated conductor trace of a ground pattern (not shown) formed on the top surface of the circuit board CB.

When the rotational actuator 45 is in the unlocked position, an FPC (flexible printed circuit) 50 that constitutes a connecting object (object to be connected to the connector 10) can be inserted into the FPC insertion groove 16 of the insulator 15 from the front side.

The FPC 50 is a long and thin plate-like member, and the thickness of the FPC 50 is smaller than the distance between the upper contacting projection 32 and the lower contacting projection 30 of each contact 25A and 25B when the contacts 25A and 25B are in a free state and also smaller than the distance between the upper engaging projection 42 and the lower engaging projection 40 of each fastening clip 35 when the fastening clips 35 are in a free state. The FPC 50 has a multi-layered structure made up of a plurality of thin films which are bonded together and includes a total of eight ground traces (conductor traces) 51, a total of fourteen circuit traces (conductor traces) 52, a cover lay (insulating cover layer) 53, a reinforcing plate 54 (see FIGS. 1 and 10) and other members. The eight ground traces 51 linearly extend along the elongated direction of the FPC 50. The fourteen circuit traces 52 are arranged such that two circuit traces 52 are positioned between any two adjacent ground traces 51. The cover lay 53 covers both sides of the FPC 50 except both ends of each ground trace 51 and both ends of each circuit trace 52. The reinforcing plate 54 is fixed to one side (the underside with respect to the drawings) of each end of the FPC 50, with respect to the elongated direction thereof, and has greater rigidity than the remaining part of the FPC 50. Additionally, the FPC 50 is provided at each end of the FPC 50, with respect to the elongated direction thereof, with a pair of engaging recesses 55, respectively.

Figure 13:
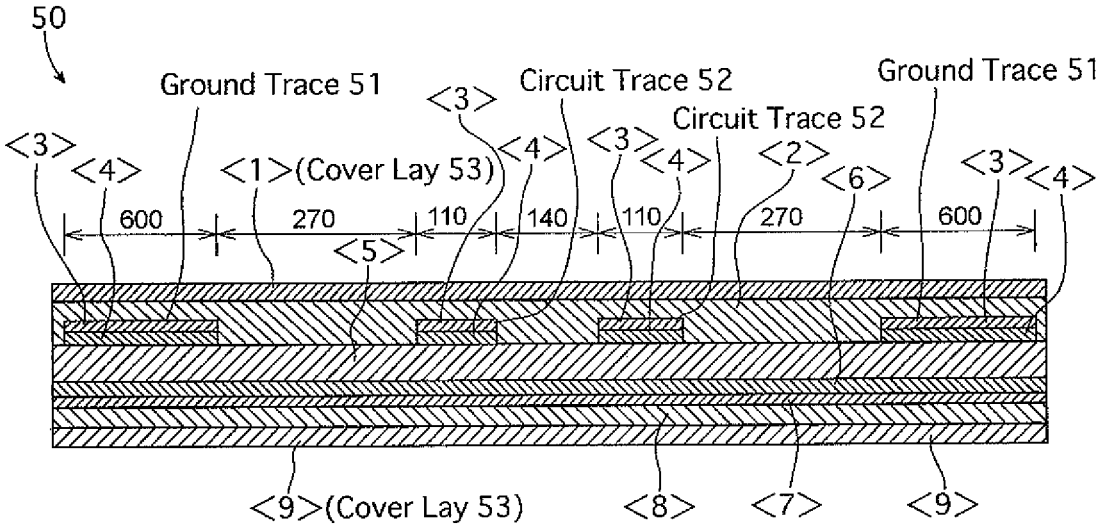
FIG. 13 is a cross sectional view taken along the line XIII-XIII shown in FIG. 12, viewed in the direction of the appended arrows.
Figure 14:
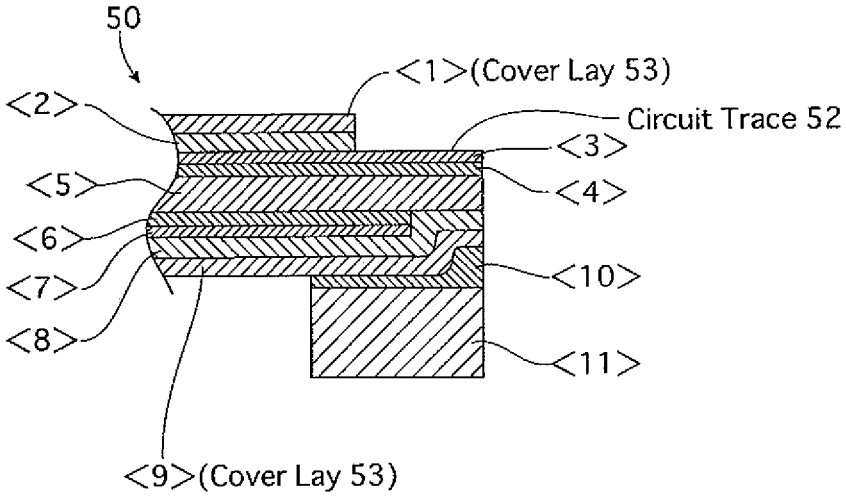
FIG. 14 is a cross sectional view taken along the line XIV-XIV shown in FIG. 13, viewed in the direction of the appended arrows.

FIGS. 13 and 14 each show a detailed cross section structure of the FPC 50. The material and thickness of each component of the FPC 50 shown in FIGS. 13 and 14 are as follows (the unit of the dimension of each component shown in FIG. 13. is μm):

| | STRUCTURE | MATERIAL | THICKNESS (μm) |
|---|---|---|---|
| <1> | Cover Lay | Polyimide | 25 |
| <2> | Adhesive Layer | Thermosetting Adhesive i. | 25 |
| <3> | Plating | Copper Through-Hole | 15 |
| <4> | Copper Leaf | Electrolytic Copper | 18 |
| <5> | Substrate | Liquid Crystal Polymer (LCP) | 50 |
| <6> | Copper Leaf | Electrolytic Copper | 18 |
| <7> | Plating | Copper Through-Hole | 15 |
| <8> | Adhesive Layer | Thermosetting Adhesive | 25 |
| <9> | Cover Lay | Polyimide | 25 |
| <10> | Adhesive Layer | Thermosetting Adhesive | 50 |
| <11> | Reinforcing Plate | Polyimide | 125 |

Figure 12:
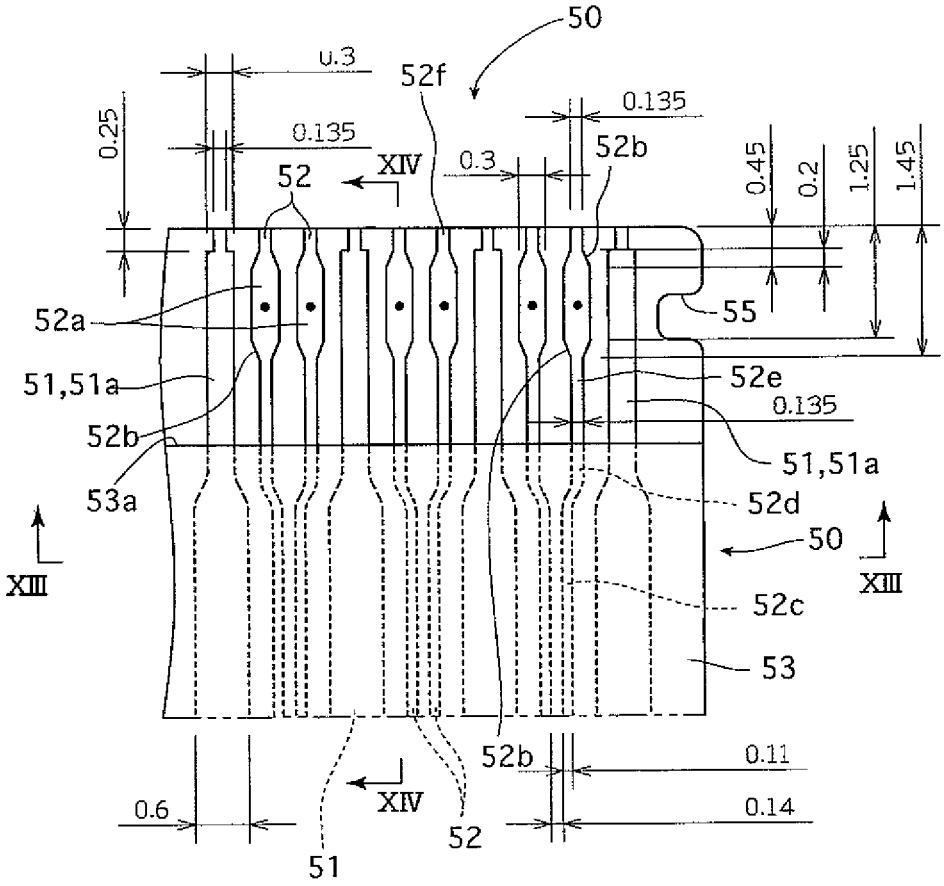
FIG. 12 is an enlarged plan view of part of the insertion end of the FPC.

As shown in FIG. 12 (the unit of the dimension of each component shown in FIG. 12 is mm), the portion of each ground trace 51 which is covered by the cover lay 53 except a portion of the aforementioned covered portion in the close vicinity of an edge 53*a* (see FIGS. 12 and 14) of the cover lay 53 is constant in width and gradually decreases in width in a direction toward the edge 53*a* of the cover lay 53 at each end of the FPC 50, with respect to the elongated direction thereof. At each end of the FPC 50, with respect to the elongated direction thereof, a land 51*a* of each ground trace 51 that is formed in the close vicinity of the end of this ground trace 51 (and that is positioned outside the cover lay 53, extending linearly from the edge 53*a*) has a constant width from the edge 53*a* to a point immediately behind the end of the FPC 50, with respect to the elongated direction thereof, and an end portion of each ground trace 51 which is closer to the end of the FPC 50, with respect to the elongated direction thereof, than the land 51*a* is smaller in width than the land 51*a*. On the other hand, the portion of each circuit trace 52 which is covered by the cover lay 53 except a portion of the aforementioned covered portion in the close vicinity of the edge 53*a* of the cover lay 53 is formed as a constant-width portion 52*c*, and a bent portion 52*d* of each circuit trace 52 which extends from the end of the constant-width portion 52*c* to the edge 53*a* of the cover lay 53 is slightly greater in width than the constant-width portion 52*c*. At each end of the FPC 50, with respect to the elongated direction thereof, an adjacent end portion (connecting portion) 52*e* (which is provided near the end of the FPC 50) of each circuit trace 52 (which is positioned outside the cover lay 53, extending linearly from the edge 53*a* to a midpoint position of the reinforcing plate 54 in the elongated direction of the FPC 50) is identical in width to the bent portion 52*c* up until the midpoint position of the reinforcing plate 54 in the elongated direction of the FPC 50, a land 52*a* of each circuit trace 52 which extends from the aforementioned mid-position to a position in the close vicinity of the end of the FPC 50 in the elongated direction thereof is greater in width than the adjacent end portion 52*e*, and an end portion 52*f* of each circuit trace 52 which extends from the land 52*a* to the end of the FPC 50 in the elongated direction thereof is smaller in width than the land 52*a* (identical in width to the adjacent end portion 52*e*). By chamfering the four corners of the land 52*a* of each circuit trace 52 as shown in FIG. 12 (i.e., by forming the same four corners into round corners in a plan view), rather than forming the same four corners into square corners, the widths of both ends 52*b* of the land 52*a* of each circuit trace 52 in the elongated direction of the FPC 50 gradually vary in the elongated direction of the FPC 50 to thereby reduce the area of the land 52*a*, which achieves a reduction in stub of the land 52*a*.

Upon one end (insertion end; the right end with respect to FIG. 11) of the FPC 50 being inserted into the FPC insertion groove 16 (the insertion/removal direction of the FPC 50 with respect to the FPC insertion groove 16 corresponds to the forward/rearward direction of the connector 10), this insertion end of the FPC 50 is positioned in each contact 25A and 25B between a front half of the fixed contact portion 26 and a front half of the movable contact portion 27. In addition, the lower engaging projections 40 of the left and right fastening clips 35 are engaged in the left and right pair of engaging recesses 55 from below, respectively, though this state of engagement is not shown in the drawings. In this state, rotating the rotational actuator 45 to the locked position causes the front end of the movable contact portion 27 of each contact 25A and 25B to rotate downward as shown in FIG. 11, thus causing the contacting projection 32 of each ground contact 25A to be pressed hard against the land 51*a* of the associated ground trace 51 of the FPC 50, causing the contacting projection 32 of each signal contact 25B to be pressed hard against the land 52*a* of the associated circuit trace 52 of the FPC 50 (a black solid circle marked on the land 52*a* of each circuit trace 52 in FIG. 12 designates a contact point with which the contacting projection 32 of the associated signal contact 25B comes into contact) and causing the contacting projection 30 of each contact 25A and 25B to be pressed hard against a lower surface of the insertion end of the FPC 50. Consequently, the circuit traces 52 of the FPC 50 and associated conductor traces of the aforementioned circuit pattern (not shown) of the circuit board CB are electrically connected via the fourteen signal contacts 25B, while the ground traces 51 of the FPC 50 and associated conductor traces of the aforementioned ground pattern (not shown) of the circuit board CB are electrically connected via the eight ground contacts 25A. In addition, the rotation of the rotational actuator 45 to the locked position causes the upper engaging projections 42 of the left and right fastening clips 35 to be engaged in the left and right pair of engaging recesses 55 from above, respectively (though this state of engagement is not shown in the drawings), to thereby prevent the FPC 50 from being withdrawn from the FPC insertion groove 16.

On the other hand, if the contact pressure exerted on the FPC 50 from each contact 25A and 25B is released while the upper engaging projections 42 of the left and right fastening clips 35 are respectively disengaged upward from the left and right pair of engaging recesses 55 by returning the rotational actuator 45 to the unlocked position, the FPC 50 can be forwardly withdrawn from the FPC insertion groove 16.

Figure 15:
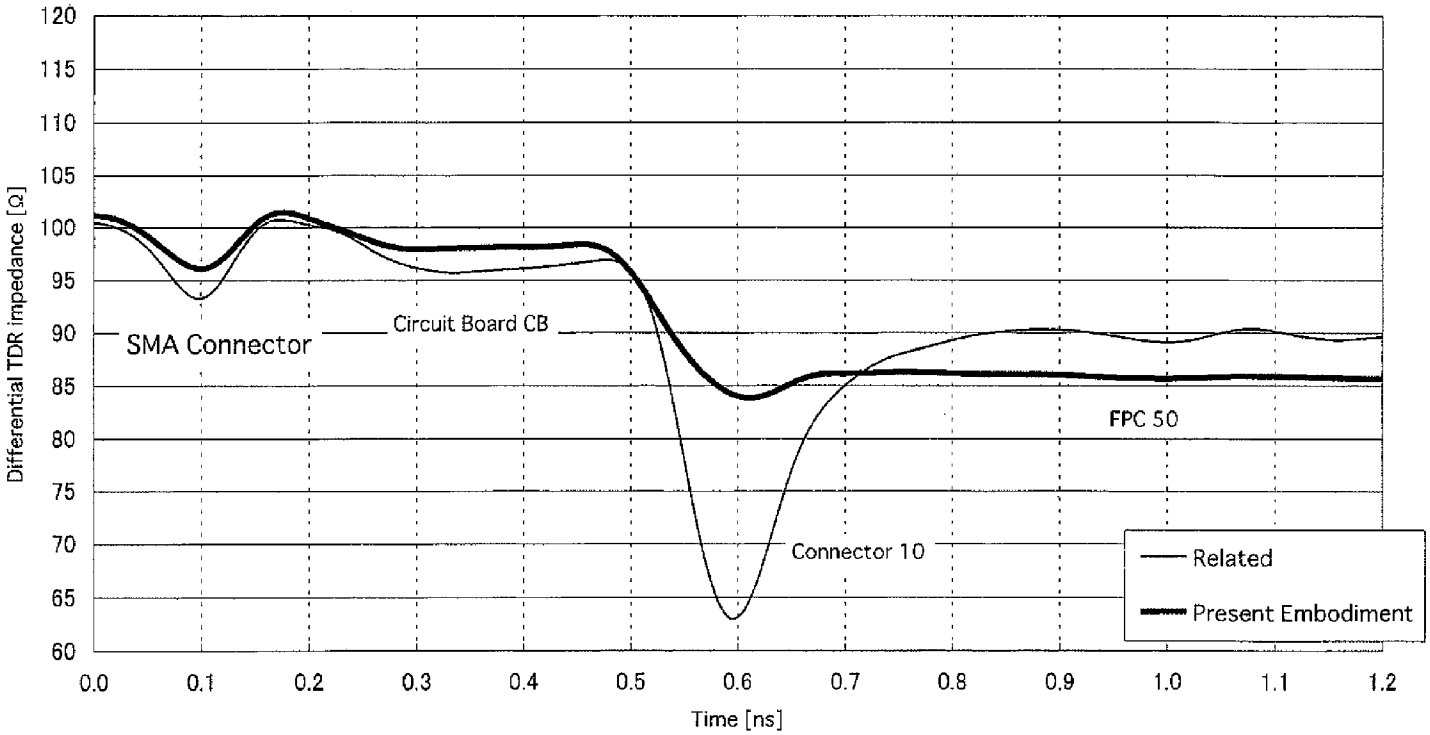
FIG. 15 is a graph illustrating the impedance when an electrical signal is supplied from a circuit board, to the connector and to the FPC.

FIG. 15 is a graph illustrating the relationship between time and the impedance (value) when an electrical signal is supplied to an SMA (Sub-Miniature version A) connector (connector for coaxial cable; not shown) connected to the circuit board CB. In the horizontal axis indicating time, the time when an electrical signal enters the SMA connector is defined as a reference time (zero). Since the electrical signal travels toward the FPC 50 as time passes, the horizontal axis practically shows positions of the signal paths of a signal which passes through the SMA connector, the circuit board CB, the connector 10 (the ground contacts 25A and the signal contacts 25B) and the FPC 50 (note that the section from 0 [ns] to approximately 0.2 [ns] corresponds to the SMA connector; the section from approximately 0.2 [ns] to approximately 0.5 [ns] corresponds to the circuit board CB; the section from approximately 0.5 [ns] to approximately 0.7 [ns] corresponds to the connector 10; and the section from approximately 0.7 [ns] onwards (rightward with respect to FIG. 15) corresponds to the FPC 50). An analysis was carried out using a vector network analyzer (E5071C) produced by Agilent Technologies in conditions in which the Tr (rise time) was 50 ps and the contact pitch was 0.5 mm.

In FIG. 15, a total of two line graphs are shown. Out of these two line graphs, the line graph that is represented by a fine line is a graph obtained when a connector similar in structure to the connector 10, in which the hollow portions 22 of the present invention are omitted (namely, a connector having a conventional configuration), is connected to the FPC 50 and the circuit board CB. As can be clearly understood from this line graph, in this case the impedances of the circuit board CB and the FPC 50 are approximately 100 ohms and approximately 90 ohms, respectively; however, the minimum impedance of the connector (contacts) is approximately 63 ohms, and accordingly, there is a large difference between this minimum impedance of the connector and the impedance of the circuit board CB and the FPC 50.

On the other hand, the line graph that is represented by a thick line in FIG. 15 is a graph obtained when the present embodiment of the connector 10 is connected to the FPC 50 and the circuit board CB. As can be understood from this graph, in this case, the impedances of the circuit board CB and the FPC 50 are approximately 100 ohms and approximately 86 ohms. However, the minimum impedance of the connector 10 (the signal contacts 25B) is approximately 84 ohms, so that it can be understood that the difference between this minimum impedance of the connector 10 and the impedance of the circuit board CB and the FPC 50 has become significantly smaller. This result is due to the formation of the hollow portions 22 in the insulator 15 that are formed in such a manner as to superimpose the deformable connecting portion 28 of each contact 25A and 25B, superimpose the fixed contact portion 26 of each contact 25A and 25B, and superimpose approximately half (½) of the movable contact portion 27 of each contact 25A and 25B (i.e., a portion of the movable contact portion 27 of each contact 25A and 25B which is positioned extending from the deformable connecting portion 28 forward), as viewed from a lateral side (the left or right side) of the insulator 15; and also due to the partition walls 21 preventing the hollow portions 22 from being communicatively connected with the contact insertion grooves 20 in the leftward/rightward direction; and also due to the hollow portions 22 being greater in width than the contact insertion grooves 20 and also being greater in dimension in the vertical direction than the contact insertion grooves 20. The relative permittivity of each hollow portion 22 (air space) is 1, thus being far lower than the relative permittivity of the synthetic resin from which the insulator 15 is made (which is approximately 3 to 4). Accordingly, the coupling capacitance between two adjacent contacts 25A and 25B, between which one hollow portion 22 is formed, does not easily increase, and hence the impedance (value) of the connector 10 is higher than that of a connector configured to have no hollow portions corresponding to the hollow portions 22. Therefore, when the connector 10 is connected to the circuit board CB and the FPC 50, the high frequency property of an electrical signal supplied to the connector 10 is improved compared with the case where a connector having a conventional structure is connected to the circuit board CB and the FPC 50.

In addition, the formation of the recess 25*a* on the fixed contact portion 26 of each contact 25A and 25B reduces the surface area of the laterally-opposed surfaces of the fixed contact portions 26 adjacent to each other (the surface area of the laterally-opposed portions of the fixed contact portions 26 adjacent to each other if the partition walls 21 were omitted); and moreover, a hollow portion (spacing) is formed between the recess 25*a* of each contact 25A and 25B and the bottom of the associated contact insertion groove 20, which makes it possible to improve the high frequency property of each contact 25A and 25B.

In addition, each hollow portion 22 that is formed on the insulator 15 is substantially (lowercase) h-shaped in a side view (resembling a reversed lowercase h lying on its side). At least a part of the rear end 19*a* of each hollow portion 22 superimposes the recess 25*a* of the fixed contact portion 26 as viewed from a lateral side of the insulator 15, which consequently increases the area of a portion of each hollow portion 22 which superimposes the associated contact insertion groove 20 (the associated contact 25A or 25B), thus making the coupling capacitance between any two adjacent contacts 25A and 25B far more difficult to increase, so that the impedance (value) of the connector 10 becomes higher than that in the case where neither the recess 25*a* nor the rear end portion 19*a* is formed.

Moreover, although the cam portion 48 of the rotational actuator 45 exerts a downward force on a portion of the upper surface of the fixed contact portion 26 of each contact 25A and 25B immediately above the recess 25*a* of the associated contact 25A or 25B (i.e., on a portion of the upper surface of the fixed contact portion 26 of each contact 25A and 25B in the vicinity of the rear end thereof) when the rotational actuator 45 is rotated, such a downward force that is exerted on the portion of the upper surface of the fixed contact portion 26 of each contact 25A and 25B in the vicinity of the rear end thereof from the cam portion 48 of the rotational actuator 45 is securely received by the bottom surface 20*a* of the insulator 15 because both the front and rear lower surfaces of the fixed contact portion 26 of each contact 25A and 25B that are positioned on the opposite sides of the recess 25*a* in the forward/rearward direction are in contact with the bottom of the associated contact insertion groove 20. Therefore, the portion of the fixed contact portion 26 of each contact 25A and 25B in the vicinity of the rear end thereof does not flex by a large amount, and accordingly, the transmission characteristics can be improved without impairing either the rotational operability of the rotational actuator 45 or the stability of the position of each contact 25A and 25B (i.e., the firmness of the fixing force of the fixed contact portion 26 of each contact 25A and 25B relative to the bottom wall 20*a* of the insulator 15), which are fundamental requirements (capabilities) for cable connectors.

Additionally, if each circuit trace 52 of the FPC 50 is structured so that the land 52*a* is directly connected to the end of the constant-width portion 52*c* (i.e., if the distance between the edge 53*a* of the cover lay 53 and the land 52*a* of each circuit trace 52 is reduced), the impedance sharply drops at the connection between the constant-width portion 52*c* and the land 52*a*.

However, in each circuit trace 52 of the present embodiment of the FPC 50, forming the adjacent end portion 52*e* which is smaller in width than the land 52*a*, extends linearly and is positioned on the outer side of the edge 53*a* of the cover lay 53, increases the distance from the edge 53*a* of the cover lay 53 to the aforementioned contact point (the position of each black solid circle shown in FIG. 12) on the land 52*a* (i.e., makes the length of the land 52*a* shorter than a conventional land), while the width of each end 52*b* of the land 52*a* is made to vary gradually. By forming each circuit trace 52 in this manner, the width of most of the area from the edge 53*a* of the cover lay 53 to the aforementioned contact point (the position of each black solid circle shown in FIG. 12) on the land 52*a* is made to be substantially constant, which prevents the impedance from dropping sharply.

Moreover, in each circuit trace 52 of the present embodiment of the FPC 50, since the land 52*a*, with which the upper contacting projection 32 of the movable contact portion 27 of the associated signal contact 25B comes into contact, is the greatest in width than any other part of the circuit tract 52, the upper contacting projection 32 and the land 52*a* can be made to come into contact with each other with reliability.

Although the present invention has been described based on the above illustrated embodiment of the connector 10, the present invention is not limited solely to this particular embodiment; making various modifications to the above illustrated embodiment of the connector 10 is possible.

Figure 16:
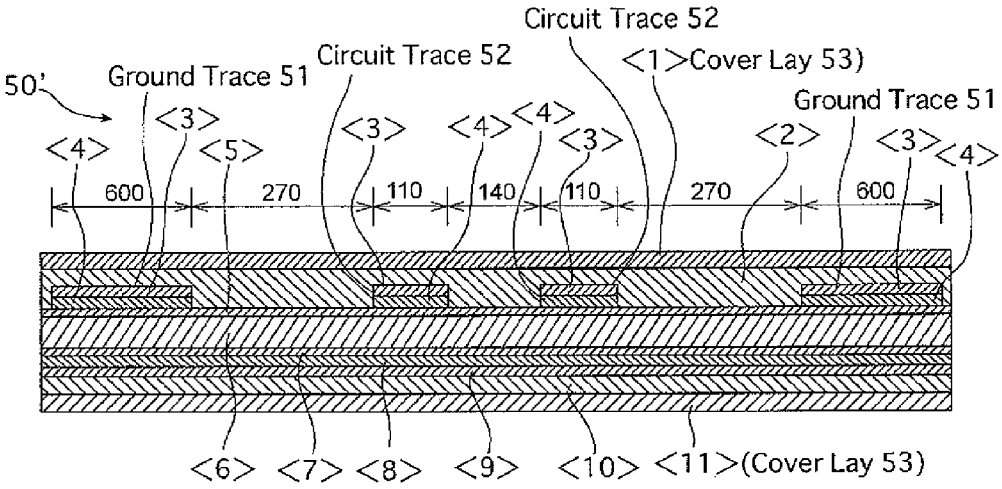
FIG. 16 is a view similar to that of FIG. 13, of an modified embodiment of the FPC.
Figure 17:
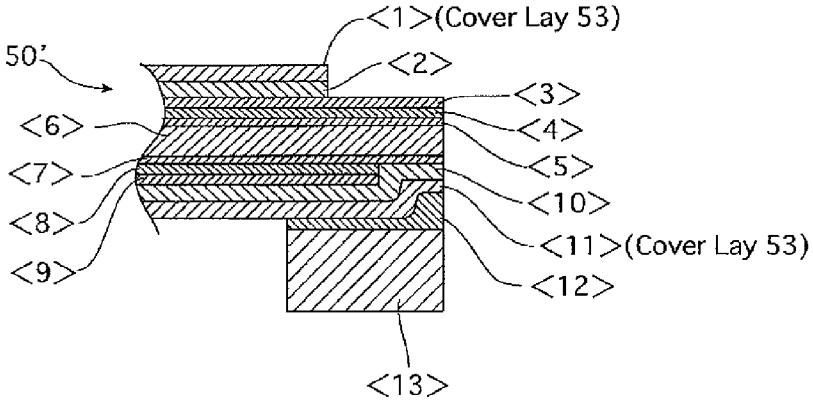
FIG. 17 is a view similar to that of FIG. 14, of the FPC shown in FIG. 16.

For instance, an FPC 50' which has the structure shown in FIGS. 16 and 17 can be used instead of the FPC 50.

The FPC 50' has a multi-layered structure made up of a plurality of thin films which are bonded together and includes a total of eight ground traces (conductor traces) 51, a total of fourteen circuit traces (conductor traces) 52 that are arranged such that two circuit traces 52 are positioned between any two adjacent ground trace 51, a cover lay 53, a reinforcing plate 54 and other members. Additionally, the FPC 50' is provided, on both side edges of each end of the FPC 50' in the elongated direction thereof, with a pair of engaging recesses 55, respectively.

The material and thickness of each component of the FPC 50' shown in FIGS. 16 and 17 are as follows (the unit of the dimension of each component shown in FIG. 16 is μm):

| | STRUCTURE | MATERIAL | THICKNESS (μm) |
|---|---|---|---|
| <1> | Cover Lay | Polyimide | 30 |
| <2> | Adhesive Layer | Thermosetting Adhesive | 25 |
| <3> | Plating | Copper Through-Hole | 15 |
| <4> | Copper Leaf | Electrolytic Copper | 18 |
| <5> | Adhesive Layer | Thermosetting Adhesive | 10 |
| <6> | Substrate | Polyimide | 25 |
| <7> | Adhesive Layer | Thermosetting Adhesive | 10 |
| <8> | Copper Leaf | Electrolytic Copper | 18 |
| <9> | Plating | Copper Through-Hole | 15 |
| <10> | Adhesive Layer | Thermosetting Adhesive | 25 |
| <11> | Cover Lay | Polyimide | 30 |
| <12> | Adhesive Layer | Thermosetting Adhesive | 50 |
| <13> | Reinforcing Plate | Polyimide | 125 |

Also in this case where the FPC 50' is connected to the connector 10, the high frequency property of an electrical signal supplied to the connector 10 is improved compared with the case where a connector having a conventional structure is connected to the circuit board CB and the FPC 50'.

In addition, if the hollow portions 22, which are formed in the partition walls 21 of the insulator 15, superimpose at least part of each contact 25A and 25B as viewed from a lateral side of the insulator 15, the shape (setting range) can be modified. For instance, it is possible to omit from the hollow portions 22 in the above described embodiment of the connector 10: (1) portions of the hollow portions 22 which superimpose the fixed contact portions 26, (2) portions of the hollow portions 22 which superimpose the movable contact portions 27, or (3) portions of the hollow portions 22 which superimpose the fixed contact portions 26 and the movable contact portions 27 (so that the hollow portions 22 include only portions thereof for superimposing the deformable connecting portions 28) as viewed from a lateral side of the insulator 15. Even in the case where any of these modifications are made to the connector 10, the impedance of the connector 10 is greater than that in the case where the hollow portions 22 are not formed in the insulator 15. According to experimental study carried out by the applicant of the present invention, portions of the hollow portions 22 which superimpose the deformable connecting portions 28, as viewed from a lateral side of the insulator 15, display a maximum effect (effect of preventing the coupling capacitance between any two adjacent contacts 25A and 25B from increasing), and accordingly, it is desirable that the hollow portions 22 be shaped so that each hollow portion 22 includes a portion superimposing the deformable connecting portions 28 as viewed from a lateral side of the insulator 15, regardless of the type of shape into which the hollow portions are formed.

The ground contacts 25A and the signal contacts 25B can be alternately arranged and inserted into the contact insertion grooves 20.

The thin plate-like connecting object can be a cable other than an FPC, e.g., an FFC (flexible flat cable).

Additionally, the positions of the lower contacting projection 30 and the upper contact projection 32 of each ground contact 25A can be relatively shifted (displaced) in the forward/rearward direction. Similarly, the positions of the lower contacting projection 30 and the upper contact projection 32 of each signal contact 25B can be relatively shifted (displaced) in the forward/rearward direction.

In addition, the connector 10 can be made as a connector for single-end transmission (all the contacts of the connector 10 can be made as signal contacts 25B) while all the conductor traces of the circuit board CB, the FPC 50 and the FPC 50' can be made as circuit traces.

It is possible to make circuit traces of the connecting object come in contact with the lower contacting portions 30 of the signal contacts 25B by inserting the connecting object into the insulator 15 with the connecting object upside down, or it is possible to form circuit traces on both sides of the connecting object so that these circuit traces (upper and lower contact traces) on both sides of the connecting object come in contact with the upper contacting portions 32 and the lower contacting portions 30 of the signal contacts 25B, respectively.

Additionally, a hook-shaped engaging portion (tail portion) corresponding to the hook-shaped engaging portion 29 can be formed at the front end of the fixed contact portion 26 of each contact 25A and 25B.

Additionally, each contact 25A and 25B can be substantially (lowercase) h-shaped in a side view (resembling a reversed lowercase h lying on its side) from which a rear half of the movable contact portion 27 (i.e., a portion thereof which is positioned rearward from the portion of the movable contact portion 27 which is connected to the deformable connecting portion 28) is omitted, or substantially U-shaped in a side view from which both a rear halves of the fixed contact portion 26 (i.e., a portion thereof which is positioned rearward from the portion of the fixed contact portion 26 which is connected to the deformable connecting portion 28) and the aforementioned rear half of the movable contact portion 27 are omitted (in this case, a hook-shaped engaging portion (tail portion) is formed at the front or rear end of the fixed contact portion 26).

Even if each contact is in the shape of a letter "H", "h" (reversed and on its side) or "U", the connector can be made as a so-called front-lock type by making the rotational actuator supported by a front half of the insulator to be rotatable between an unlocked position, in which the rotational actuator oriented substantially orthogonal to the insulator 15, and a locked position, in which the rotational actuator lies substantially horizontal (i.e., the rotational actuator has been tilted forwardly down). In this case, a cam portion (pressing portion) formed on part of the rotational actuator is positioned between the fixed contact portions 26 and the movable contact portions 27 of the contacts 25A and 25B while the connecting object that is inserted into the insulator is positioned immediately below the cam portion. When this rotational actuator is in the unlocked position, the pressing portion that is positioned immediately above the connecting object does not press the connecting object downward. On the other hand, when this rotational actuator is in the locked position, the pressing portion presses the connecting object downward to make conductor traces of a circuit pattern (not shown) that are formed on the lower surface of the connecting object come in contact with the lower contacting projections 30 of the contacts 25A and 25B.

Additionally, in the case where each contact is shaped into a substantially letter "h" (reversed and on its side) or "U", a recess corresponding to the recess 25*a* can be formed in a lower surface (which faces the bottom wall 20*a*) of the fixed contact portion of each contact. In this case also, it is desirable that both the front and rear lower surfaces of the fixed contact portion of each contact 25A and 25B that are positioned on the opposite sides of the recess in the forward/rearward direction be in contact with the bottom of the associated contact insertion groove 20.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A connector comprising:

an insulator, into which a thin plate-like object to be connected to said connector is removably insertable, including a plurality of contact insertion grooves and a plurality of partition walls that are positioned between said contact insertion grooves to separate said contact insertion grooves from one another, said contact insertion grooves being elongated in an insertion/removal direction of said thin plate-like object and arranged in a direction orthogonal to said insertion/removal direction; and a plurality of contacts which are inserted into said contact insertion grooves, respectively, each of said contacts including a first contact portion and a second contact portion that are spaced from each other in a direction of thickness of said thin plate-like object to allow said thin plate-like object to be inserted in between said first contact portion and said second contact portion, and further including a connecting portion which connects said first contact portion and said second contact portion to each other, wherein at least one of said first contact portion and said second contact portion comes in contact with said thin plate-like object when said thin plate-like object is inserted into said insulator, wherein a hollow portion having a greater width than each of said contact insertion grooves is formed in each of said partition walls of said insulator in a manner such that said hollow portion superimposes part of each contact of said contacts as viewed in a contact arranging direction in which said contacts are arranged, and in a manner such that each of said plurality of partition walls prevents each corresponding said hollow portion from being communicatively connected with said contact insertion grooves in said contact arranging direction.

2. The connector according to claim 1, wherein said hollow portion is greater in dimension in said direction of thickness of said thin plate-like object than each of said contact insertion grooves.

3. The connector according to claim 1, wherein said hollow portion is formed in said insulator so as to superimpose part of said connecting portions of said plurality of contacts as viewed in said contact arranging direction.

4. The connector according to claim 3, wherein said first contact portion is fixed to a bottom wall of said insulator, and wherein said hollow portion is formed in said insulator so as to superimpose both said first contact portion and a portion of said second contact portion extending from said connecting portion and along said second contact portion said insertion/removal direction as viewed from a lateral side of said insulator.

5. The connector according to claim 1, wherein a recess is formed on a surface of said first contact portion which faces said bottom wall of said insulator.

6. The connector according to claim 5, wherein said hollow portion is formed in said insulator so as to superimpose said recess as viewed in said contact arranging direction.

7. The connector according to claim 1, wherein said thin plate-like object comprises an FPC including at least one circuit trace which extends along an elongated direction of said thin plate-like object; and an insulating cover layer which covers both sides of said FPC except both ends of said circuit trace, and wherein said circuit trace comprises:

a land which is positioned outside said insulating cover layer and comes into contact with at least one of said first contact portion and said second contact portion, an end of said land adjacent to an edge of said insulating cover layer being formed to decrease in width gradually in a direction toward said edge of said insulating cover layer; and a connecting portion which is smaller in width than said land, except said end of said land, and extends linearly from said end of said land to said edge of said insulating cover layer.

8. The connector according to claim 7, wherein said FPC further includes at least one ground trace which extends along said elongated direction of said thin plate-like object.

* * * * *